US010642297B2

(12) United States Patent
Peng et al.

(10) Patent No.: US 10,642,297 B2
(45) Date of Patent: May 5, 2020

(54) ONLINE VOLTAGE ADJUSTMENT CIRCUIT FOR BOARD POWER SUPPLY

(71) Applicant: Huawei Technologies Co., Ltd., Shenzhen (CN)

(72) Inventors: Yunwu Peng, Shenzhen (CN); Qi Peng, Chengdu (CN); Xuejing Zhang, Chengdu (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 16/415,527

(22) Filed: May 17, 2019

(65) Prior Publication Data

US 2019/0271999 A1 Sep. 5, 2019

Related U.S. Application Data

(63) Continuation of application No. PCT/CN2017/110878, filed on Nov. 14, 2017.

(30) Foreign Application Priority Data

Nov. 17, 2016 (CN) ..... 2016 1 1011162

(51) Int. Cl.
*G05F 1/575* (2006.01)
*G05F 1/56* (2006.01)

(52) U.S. Cl.
CPC ..... *G05F 1/575* (2013.01); *G05F 1/56* (2013.01)

(58) Field of Classification Search
None
See application file for complete search history.

(56) References Cited

U.S. PATENT DOCUMENTS 5,949,197 A * 9/1999 Kastner ..... H05B 41/2851 315/291
7,196,499 B1 * 3/2007 Lipcsei ..... H02M 3/1588 323/222

(Continued)

FOREIGN PATENT DOCUMENTS

CN 1904790 A 1/2007
CN 101968668 A 2/2011

(Continued)

OTHER PUBLICATIONS

Machine Translation and Abstract of Chinese Publication No. CN1904790, Jan. 31, 2007, 6 pages.

(Continued)

*Primary Examiner* — Cassandra F Cox
(74) *Attorney, Agent, or Firm* — Conley Rose, P.C.

(57) ABSTRACT

An online voltage adjustment circuit for a board power supply, where a first voltage division circuit is coupled in parallel to a first bias resistor, a second voltage division circuit is coupled in parallel to a second bias resistor, and a detection chip obtains an initial output voltage of the board power supply. Based on the initial output voltage and a preset voltage, a control chip controls a first switch on the first voltage division circuit to be on or off, and a second switch on the second voltage division circuit to be on or off. As a result, a feedback value of a feedback pin of the board power supply changes, and then an output voltage of the board power supply changes, thereby adjusting the output voltage of the board power supply.

20 Claims, 5 Drawing Sheets

(56) References Cited

U.S. PATENT DOCUMENTS

| | | | |
|---|---|---|---|
| 2012/0112725 | A1 | 5/2012 | Li et al. |
| 2013/0193939 | A1 | 8/2013 | Sakaguchi et al. |
| 2014/0062432 | A1 | 3/2014 | Goto |

FOREIGN PATENT DOCUMENTS

| | | | |
|---|---|---|---|
| CN | 102467144 | A | 5/2012 |
| CN | 102721916 | A | 10/2012 |
| CN | 103226370 | A | 7/2013 |
| CN | 203397234 | U | 1/2014 |
| CN | 104238609 | A | 12/2014 |
| CN | 204794683 | U | 11/2015 |
| CN | 105915029 | A | 8/2016 |
| CN | 205427681 | U | 8/2016 |

OTHER PUBLICATIONS

Machine Translation and Abstract of Chinese Publication No. CN101968668, Feb. 9, 2011, 17 pages.

Machine Translation and Abstract of Chinese Publication No. CN102721916, Oct. 10, 2012, 11 pages.

Machine Translation and Abstract of Chinese Publication No. CN104238609, Dec. 24, 2014, 8 pages.

Machine Translation and Abstract of Chinese Publication No. CN105915029, Aug. 31, 2016, 15 pages.

Machine Translation and Abstract of Chinese Publication No. CN203397234, Jan. 15, 2014, 14 pages.

Machine Translation and Abstract of Chinese Publication No. CN204794683, Nov. 18, 2015, 4 pages.

Machine Translation and Abstract of Chinese Publication No. CN205427681, Aug. 3, 2016, 11 pages.

Foreign Communication from A Counterpart Application, Chinese Application No. 201611011162.0, Chinese Office Action dated Mar. 4, 2019, 28 pages.

Foreign Communication From A Counterpart Application, PCT Application No. PCT/CN2017/110878, English Translation of International Search Report dated Jan. 11, 2018, 2 pages.

Foreign Communication From A Counterpart Application, PCT Application No. PCT/CN2017/110878, English Translation of Written Opinion dated Jan. 11, 2018, 3 pages.

* cited by examiner

ONLINE VOLTAGE ADJUSTMENT CIRCUIT FOR BOARD POWER SUPPLY

CROSS-REFERENCE TO RELATED APPLICATIONS

This application is a continuation of International Patent Application No. PCT/CN2017/110878 filed on Nov. 14, 2017, which claims priority to Chinese Patent Application No. 201611011162.0 filed on Nov. 17, 2016. The disclosures of the aforementioned applications are hereby incorporated by reference in their entireties.

TECHNICAL FIELD

Embodiments of this application relate to power circuit technologies, and in particular, to an online voltage adjustment circuit for a board power supply.

BACKGROUND

With rapid development of computer technologies and network technologies, a signal transmission rate becomes increasingly higher, and requirements on output accuracy and reliability of a board power supply also become increasingly higher. In addition, increasingly more electronic components are integrated on the board power supply, and therefore a processing technique is complex. In a board power supply development or production phase, board power supplies that undergo a strict test by a manufacturer still have a specific failure rate. Even though some board power supplies pass an automatic test equipment (ATE) check, a specific percentage of the board power supplies become faulty soon.

In a whole-machine test phase of an electronic device, an online voltage adjustment circuit for a board power supply is used to adjust an output voltage of the board power supply to implement secondary filtering of the board power supply, thereby ensuring relatively strong stability of the board power supply when a range of the output voltage of the board power supply is relatively large, to be specific, ensuring that a design of the board power supply has a specific margin. In an adjustment process, a bias resistor is welded on a feedback (FB) pin of the board power supply. A resistance value of the bias resistor is adjusted such that the FB pin obtains different FB values, and further the board power supply outputs different voltages.

In the foregoing board power supply adjustment process, the bias resistor needs to be manually welded. This is time- and labor-consuming, poor welding easily occurs, and an operation process is complex.

SUMMARY

Embodiments of this application provide an online voltage adjustment circuit for a board power supply. An output voltage of the board power supply is adjusted online to reduce complexity of adjustment of the board power supply.

According to a first aspect, an embodiment of this application provides an online voltage adjustment circuit for a board power supply, including a detection chip, a control chip, a first voltage division element, a second voltage division element, a first switch, a second switch, a first bias resistor, and a second bias resistor. A first voltage division circuit is connected in parallel to the first bias resistor, a second voltage division circuit is connected in parallel to the second bias resistor, the detection chip obtains an initial output voltage of the board power supply, and finally, based on the initial output voltage and a preset voltage, the control chip controls on/off of the first switch on the first voltage division circuit, and on/off of the second switch on the second voltage division circuit such that an FB value of an FB pin of the board power supply changes, and then an output voltage of the board power supply changes, thereby adjusting the output voltage of the board power supply.

In the foregoing circuit, during online voltage adjustment, instead of manually welding the bias resistors, the control chip automatically controls on/off of the first switch and the second switch such that the output voltage of the board power supply changes, thereby reducing complexity of adjustment of the output voltage of the board power supply.

With reference to the first aspect, in a possible implementation of the first aspect, the first voltage division element includes a first voltage division resistor, and the second voltage division element includes a second voltage division resistor. When the control chip controls the first switch to be off and the second switch to be off, the initial output voltage is used as a target voltage. Alternatively, when the control chip controls the first switch to be on and the second switch to be off, the initial output voltage is increased to a first voltage, and the first voltage is used as a target voltage. Alternatively, when the control chip controls the first switch to be off and the second switch to be on, the initial output voltage is reduced to a second voltage, and the second voltage is used as a target voltage.

In the foregoing circuit, in the online voltage adjustment process for the board power supply, the detection chip samples the output voltage of the output pin to obtain the initial output voltage, and sends the initial output voltage to the control chip. The control chip controls on/off of the first voltage division resistor and the second voltage division resistor based on the preset voltage and the initial output voltage to adjust the initial output voltage to the target voltage, thereby implementing online voltage adjustment of a fixed bias of the output voltage.

With reference to the first aspect and the foregoing possible implementation of the first aspect, in another possible implementation of the first aspect, the first voltage division element includes a first digital potentiometer, the second voltage division element includes a second digital potentiometer, and the control chip is further connected to the first digital potentiometer and the second digital potentiometer. When the control chip controls the first switch to be off and the second switch to be off, the initial voltage is used as the target voltage. Alternatively, when the control chip controls the first switch to be on and the second switch to be off, the initial voltage is increased to the first voltage, and the first voltage is used as the target voltage. Alternatively, when the control chip controls the first switch to be off and the second switch to be on, the output voltage is reduced to the second voltage, and the second voltage is used as the target voltage. Alternatively, when the control chip controls the first switch to be on and the second switch to be off, and adjusts the first digital potentiometer, the target voltage is between the initial voltage and the first voltage. Alternatively, when the control chip controls the first switch to be off and the second switch to be on, and adjusts the second digital potentiometer, the target voltage is between the second voltage and the initial voltage. Alternatively, when the control chip controls the first switch to be on and the second switch to be on, and adjusts the first digital potentiometer and the second digital potentiometer, the target voltage is between the second voltage and the first voltage.

In the foregoing circuit, in the online voltage adjustment process for the board power supply, the detection chip samples the output voltage of the output pin to obtain the initial output voltage, and sends the initial output voltage to the control chip. The control chip controls the first digital potentiometer and the second digital potentiometer based on the preset voltage and the initial output voltage to change an FB value, and adjust the initial output voltage to the target voltage, thereby implementing online voltage adjustment of a dynamic bias of the output voltage.

With reference to the first aspect and the possible implementations of the first aspect, in another possible implementation of the first aspect, the first switch is a switching transistor or a metal-oxide semiconductor field-effect transistor, and the second switch is a switching transistor or a metal-oxide semiconductor field-effect transistor.

With reference to the first aspect and the possible implementations of the first aspect, in another possible implementation of the first aspect, the control chip is further configured to obtain the preset voltage.

In the online voltage adjustment circuit for the board power supply that is provided in the embodiments of the present disclosure, the first voltage division circuit is connected in parallel to the first bias resistor, the second voltage division circuit is connected in parallel to the second bias resistor, the detection chip obtains the initial output voltage of the board power supply, and finally, based on the initial output voltage and the preset voltage, the control chip controls on/off of the first switch on the first voltage division circuit, and on/off of the second switch on the second voltage division circuit such that the FB value of the FB pin of the board power supply changes, and then the output voltage of the board power supply changes, thereby adjusting the output voltage of the board power supply. In the adjustment process, instead of manually welding the bias resistors, the control chip automatically controls on/off of the first switch and the second switch such that the output voltage of the board power supply changes, thereby reducing the complexity of adjustment of the output voltage of the board power supply.

DESCRIPTION OF EMBODIMENTS

Generally, a specific margin needs to be designed for a board power supply of an electronic device to ensure strong stability when a range of an output voltage of the board power supply is relatively large. In an adjustment process, a bias resistor is welded on an FB pin of the board power supply. A resistance value of the bias resistor is adjusted such that the FB pin obtains different FB values, and further the board power supply outputs different voltages. Further, referring to FIG. 1, FIG. 1 is a schematic diagram of an online voltage adjustment circuit for a board power supply.

Figure 1:
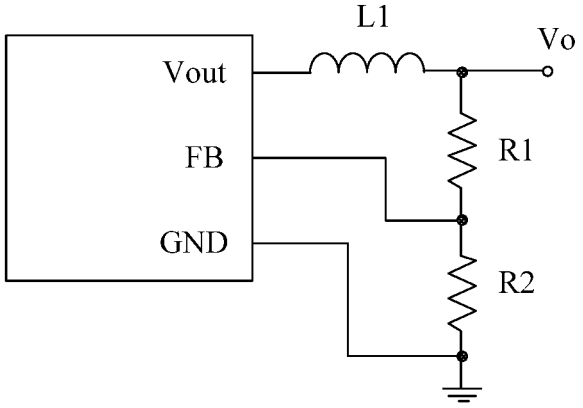
FIG. 1 is a schematic diagram of a current online voltage adjustment circuit for a board power supply.

Referring to FIG. 1, in a board power supply development phase, bias resistors R1 and R2 are manually welded to perform a high-low bias test on the board power supply, thereby verifying a designed margin of the board power supply. For example, when a bias greater than ±5% needs to be verified, resistance values of R1 and R2 are set such that when a high bias or a low bias of an output voltage (Vout) of an output pin of the board power supply is less than 5%, a stable output voltage can still be provided to ensure normal working of load that is supplied by the board power supply. For another example, when a bias greater than ±3% needs to be verified, resistance values of R1 and R2 are set such that when a high bias or a low bias of an output voltage of the board power supply is less than 3%, a stable output voltage can still be provided to ensure normal working of load that is supplied by the board power supply. When different accuracy requirements are imposed on the high-low bias verification, R1 has a same resistance value or different resistance values, and R2 has a same resistance value or different resistance values.

In the foregoing online voltage adjustment circuit for the board power supply, the bias resistors R1 and R2 need to be manually welded. This is time- and labor-consuming, poor welding easily occurs, and an operation process is complex.

In view of the above, embodiments of this application provide an online voltage adjustment circuit for a board power supply. An output voltage of the board power supply is adjusted online to reduce complexity of adjustment of the board power supply. Further, referring to FIG. 2, FIG. 2 is a schematic structural diagram of Embodiment 1 of an online voltage adjustment circuit for a board power supply according to this application.

Figure 2:
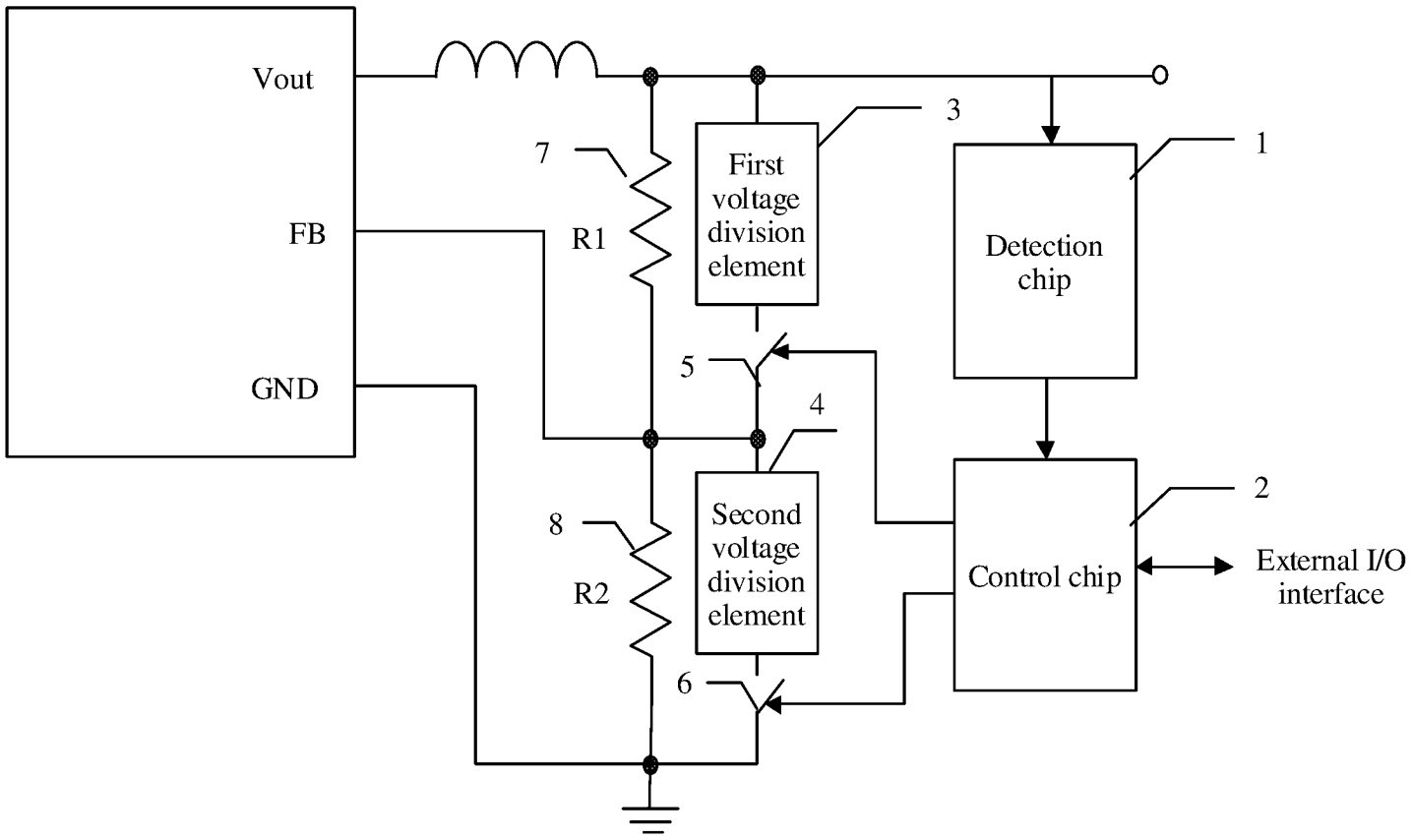
FIG. 2 is a schematic structural diagram of Embodiment 1 of an online voltage adjustment circuit for a board power supply according to this application.

Referring to FIG. 2, in this embodiment of this application, the online voltage adjustment circuit for the board power supply includes a detection chip 1, a control chip 2, a first voltage division element 3, a second voltage division element 4, a first switch 5, a second switch 6, a first bias resistor (designated as R1) 7, and a second bias resistor (designated as R2) 8. The first voltage division element 3 is connected in series to the first switch 5 to form a first voltage division circuit, the first voltage division circuit is connected in parallel to the first bias resistor 7, the second voltage division element 4 is connected in series to the second switch 6 to form a second voltage division circuit, and the second voltage division circuit is connected in parallel to the second bias resistor 8. The first bias resistor 7 is connected in series to the second bias resistor 8, and the first voltage division circuit is connected in series to the second voltage division circuit. An FB pin of the board power supply and a first connection point are separately connected to a second connection point, one end that is of the first bias resistor 7 and that is far away from the second connection point is connected to an output (designated as Vout) pin of the board power supply, and one end that is of the second bias resistor 8 and that is far away from the second connection point is connected to a ground (designated as GND) pin of the board power supply. The first connection point is a connection point between the first voltage division circuit and the second voltage division circuit, and the second connection point is a connection point between the first bias resistor 7 and the second bias resistor 8. A first end of the detection chip 1 is connected to the output pin, a second end of the detection chip 1 is connected to the control chip 2, and the detection chip 1 is configured to obtain an initial output voltage of the output pin. The control chip 2 is connected to the first switch 5 and the second switch 6, and is configured to control on/off of the first switch 5 and the second switch 6 based on the output voltage and a preset voltage in order to adjust the initial voltage to a target voltage.

In the foregoing circuit, the detection chip 1 is a voltage detection chip that can sample an output voltage of the board power supply. For example, the detection chip 1 is a multi-channel voltage detection chip. The control chip 2 is, for example, advanced reduced instruction set computing (RISC) machines (ARM), a micro control unit (MCU), or a complex programmable logical device (CPLD). A connection between the detection chip 1 and the control chip 2 is established using an inter-integrated circuit (I2C) or a low pin count (LPC) interface. In an output voltage adjustment process, the detection chip 1 samples an output (Vout) of the output pin of the board power supply to obtain the initial output voltage, and then sends the obtained initial output voltage to the control chip 2. The control chip 2 controls, based on a preset voltage and the initial output voltage, on/off of the first voltage division circuit that is in a parallel connection to the first bias resistor 7, and/or controls, based on a preset voltage and the initial output voltage, on/off of the second voltage division circuit that is in a parallel connection to the second bias resistor 8 in order to adjust the initial output voltage to the target voltage. The preset voltage is, for example, a voltage employed for load that is supplied by the board power supply. The preset voltage may be preset, or may be obtained by the control chip 2 using an external input/output (I/O) interface. For example, when the initial output voltage is relatively small and the output voltage of the board power supply needs to be increased, the control chip 2 controls the first switch 5 to be on and the second switch 6 to be off. In this case, a voltage at the second connection point increases, an input value of the FB pin of the board power supply increases, and the output voltage of the output pin of the board power supply increases accordingly. For another example, when the initial output voltage is relatively large and the output voltage of the board power supply needs to be reduced, the control chip 2 controls the first switch 5 to be off and the second switch 6 to be on. In this case, a voltage at the second connection point decreases, an input value of the FB pin of the board power supply decreases, and the output voltage of the output pin of the board power supply decreases accordingly.

When the online voltage adjustment circuit for the board power supply is applied to verification in a board power supply development phase, the control chip 2 dynamically adjusts the output voltage of the output pin of the board power supply using an external input interface, such as a management network port, a Universal Serial Bus (USB) port, or a serial port in order to implement a high-low bias test on the output voltage of the board power supply, reduce workload of manually welding the bias resistors, and improve test efficiency in verification.

Generally, in the case of mass production of board power supplies, output voltages of the board power supplies should be adjusted. If R1 and R2 are installed in a manner shown in FIG. 1, different R1*s* and different R2*s* may be manually installed based on different high-low bias amplitudes. This may not be feasible. If an electrical stress is applied to enhance reliability filtering, load of a voltage chip needs to be increased, a temperature stress should be increased, and an incubator device should be used, increasing costs of production and processing. In this case, the foregoing online voltage adjustment circuit for the board power supply is used to dynamically adjust the output voltage of the board power supply. This increases power supply test pressure, and helps more quickly filter out a defective product. In addition, through an online voltage high-low bias test, a requirement on an ambient temperature stress can be properly reduced, and the costs of production and processing can be reduced.

When the board power supply is abnormal or the output voltage fluctuates or drifts because of poor welding of peripheral components, online detection is performed and the input value of the FB pin of the board power supply is adjusted to correct the output voltage of the output pin, thereby restoring the output voltage online and reducing a failure of the board power supply caused by a power supply.

In addition, when a voltage range of load that is supplied by the board power supply is relatively large, the output pin may be controlled, based on a size of the load to output different voltage values such that the board power supply works in a load interval with highest conversion efficiency, and power consumption of the load is minimized in a standby mode. For example, it is assumed that a power of the load is P. When $P \geq 70\%$, it is considered that the board power supply is in a heavy load state, and the output voltage is dynamically adjusted to increase the output voltage, and reduce a current value. When $70\% > P \geq 30\%$, it is considered that the board power supply is in a half-load state, and the output voltage is dynamically adjusted such that the board power supply outputs a normal voltage value. When $30 \geq P > 5\%$, it is considered that the board power supply is in a light load state, and the output voltage is dynamically adjusted to reduce the output voltage, and increase a current value, thereby increasing conversion efficiency of the board power supply. When $P \leq 5\%$, it is considered that the board power supply is in an idle state, and the output voltage is dynamically adjusted to reduce the output voltage such that a current value is close to 0, thereby reducing power consumption of the load in a standby mode.

In the online voltage adjustment circuit for the board power supply that is provided in this embodiment of this application, the first voltage division circuit is connected in parallel to the first bias resistor, the second voltage division circuit is connected in parallel to the second bias resistor, the detection chip obtains the initial output voltage of the board power supply, and finally, based on the initial output voltage and the preset voltage, the control chip controls on/off of the first switch on the first voltage division circuit, and on/off of the second switch on the second voltage division circuit such that an FB value of the FB pin of the board power supply changes, and then the output voltage of the board power supply changes, thereby adjusting the output voltage of the board power supply. In the adjustment process, instead of manually welding the bias resistors, the control chip automatically controls on/off of the first switch and the second switch such that the output voltage of the board power supply changes, thereby reducing complexity of adjustment of the output voltage of the board power supply.

In a feasible implementation, the first voltage division element 3 includes a first voltage division resistor, and the second voltage division element 4 includes a second voltage division resistor. Further, referring to FIG. 3A and FIG. 3B, FIG. 3A is a schematic structural diagram of Embodiment 2 of an online voltage adjustment circuit for a board power supply according to this application, and FIG. 3B is a waveform graph of an output voltage in FIG. 3A.

Figure 3A:
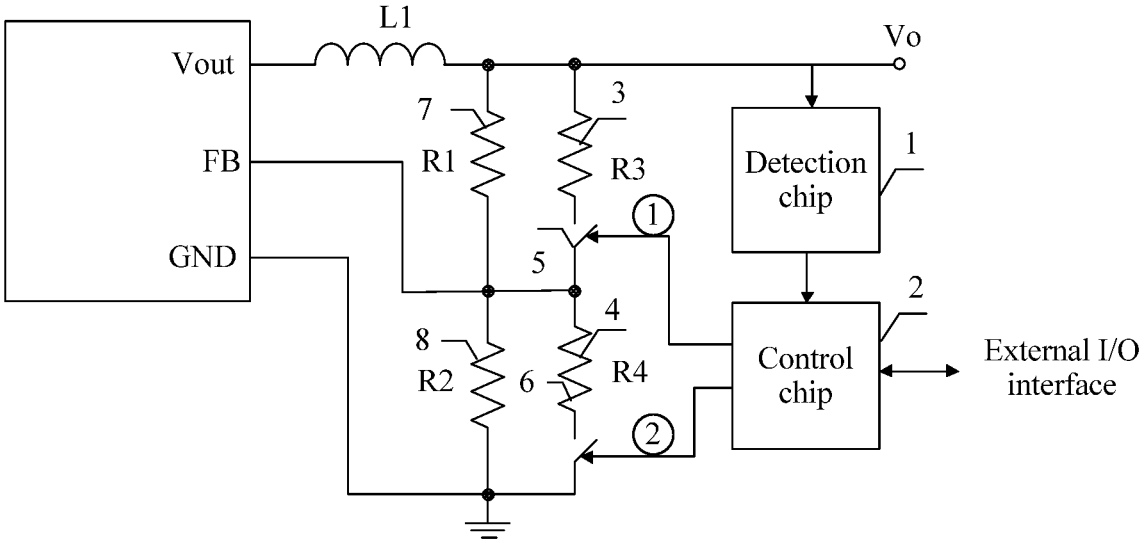
FIG. 3A is a schematic structural diagram of Embodiment 2 of an online voltage adjustment circuit for a board power supply according to this application.
Figure 3B:
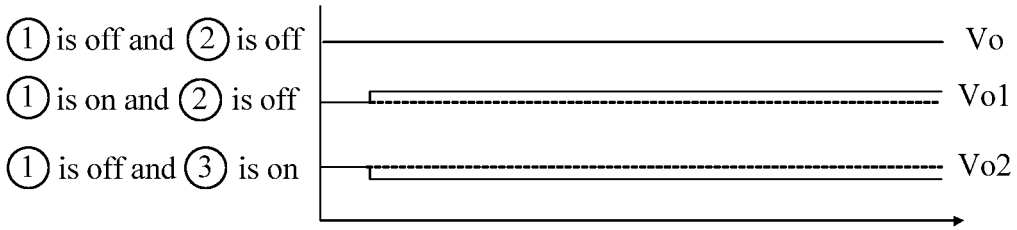
FIG. 3B is a waveform graph of an output voltage in FIG. 3A.

Referring to FIG. 3A, a first bias resistor 7 is R1, a second bias resistor 8 is R2, a first voltage division resistor is R3, and a second voltage division resistor is R4. In an online voltage adjustment process for the board power supply, a detection chip 1 samples an output voltage of an output pin to obtain an initial output voltage, and sends the initial output voltage to a control chip 2. The control chip 2 controls on/off of R3 and R4 based on a preset voltage and the initial output voltage to adjust the initial output voltage to a target voltage, thereby implementing online voltage adjustment of a fixed bias of the output voltage. A fixed bias ratio is determined based on resistance values of R3 and R4, and the adjustment and change are shown in Table 1.

TABLE 1

| Sequence number | Control sequence | Change of an FB value | Change of an output voltage Vo | Symbol Vo |
|---|---|---|---|---|
| 0 | ① is off and ② is off | — | — | Vo |
| 1 | ① is on and ② is off | ↑ | ↑ | Vo1 |
| 2 | ① is off and ② is on | ↓ | ↓ | Vo2 |

Referring to Table 1, a first switch 5 is denoted as ①, a second switch 6 is denoted as ②, an input value of an FB pin is denoted as an FB value, and the initial output voltage is denoted as Vo. In this case, when the control chip 2 controls the first switch 5 to be off and the second switch 6 to be off, the output voltage of the board power supply remains unchanged, to be specific, the initial voltage is used as the target voltage. When the control chip 2 controls the first switch 5 to be on and the second switch 6 to be off, the FB value of the board power supply increases, and the output voltage also increases. For example, the initial output voltage increases to a first voltage Vo1, and Vo1 is used as the target voltage, and a value of Vo1 is related to the resistance values of R1, R2 and R3. When the control chip 2 controls the first switch 5 to be off and the second switch 6 to be on, the FB value of the board power supply decreases, and the output voltage also decreases. For example, the initial output voltage decreases to a second voltage Vo2, Vo2 is used as the target voltage, and a value of Vo2 is related to the resistance values of R1, R2 and R4.

Referring to FIG. 3B, when the control chip 2 controls states of the first switch and the second switch to change, the output voltage of the board power supply, namely, a waveform of the target voltage, also changes.

It should be noted that the circuit in FIG. 3A shows only partial components, and the circuit provided in this embodiment of this application further includes another element, such as an inductor L.

In another feasible implementation, the first voltage division element 3 includes a first digital potentiometer, the second voltage division element 4 includes a second digital potentiometer, and the control chip 2 is further connected to the first digital potentiometer and the second digital potentiometer. Further, referring to FIG. 4A and FIG. 4B, FIG. 4A is a schematic structural diagram of Embodiment 3 of an online voltage adjustment circuit for a board power supply according to this application, and FIG. 4B is a waveform graph of an output voltage in FIG. 4A.

Figure 4A:
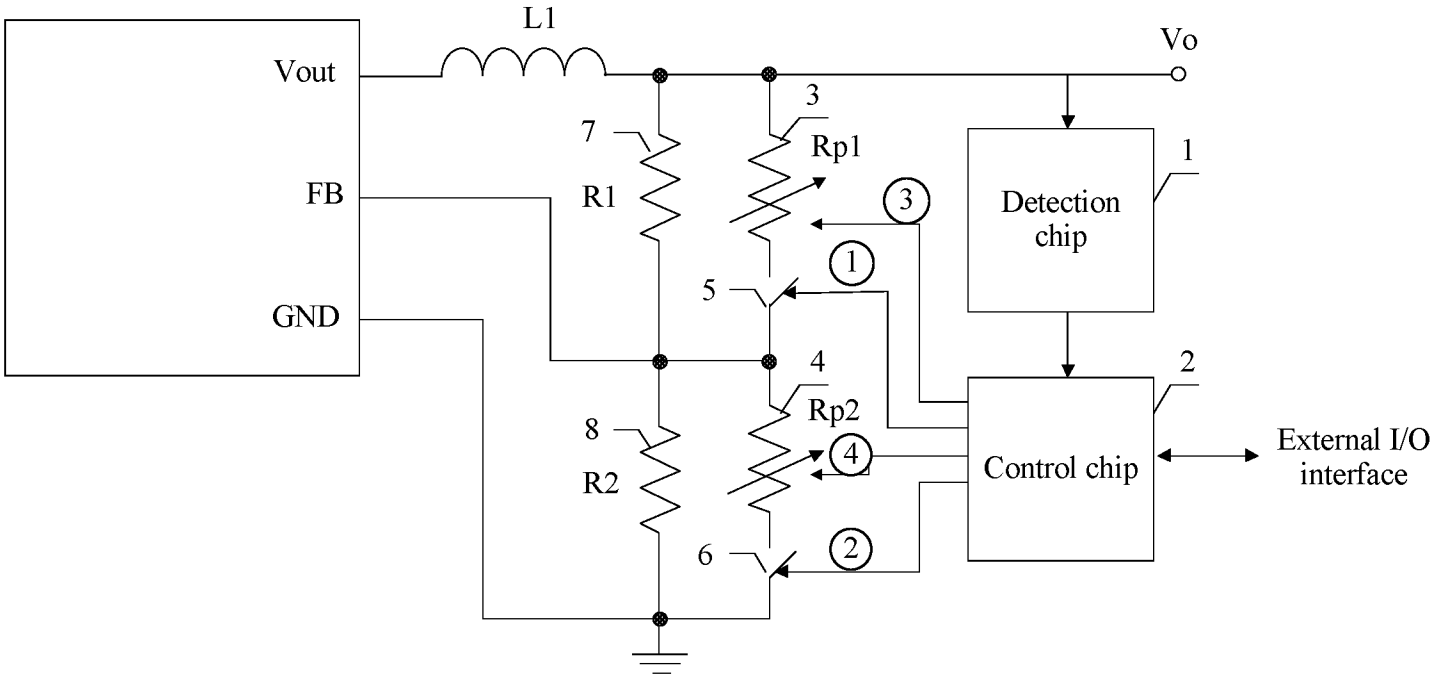
FIG. 4A is a schematic structural diagram of Embodiment 3 of an online voltage adjustment circuit for a board power supply according to this application.
Figure 4B:
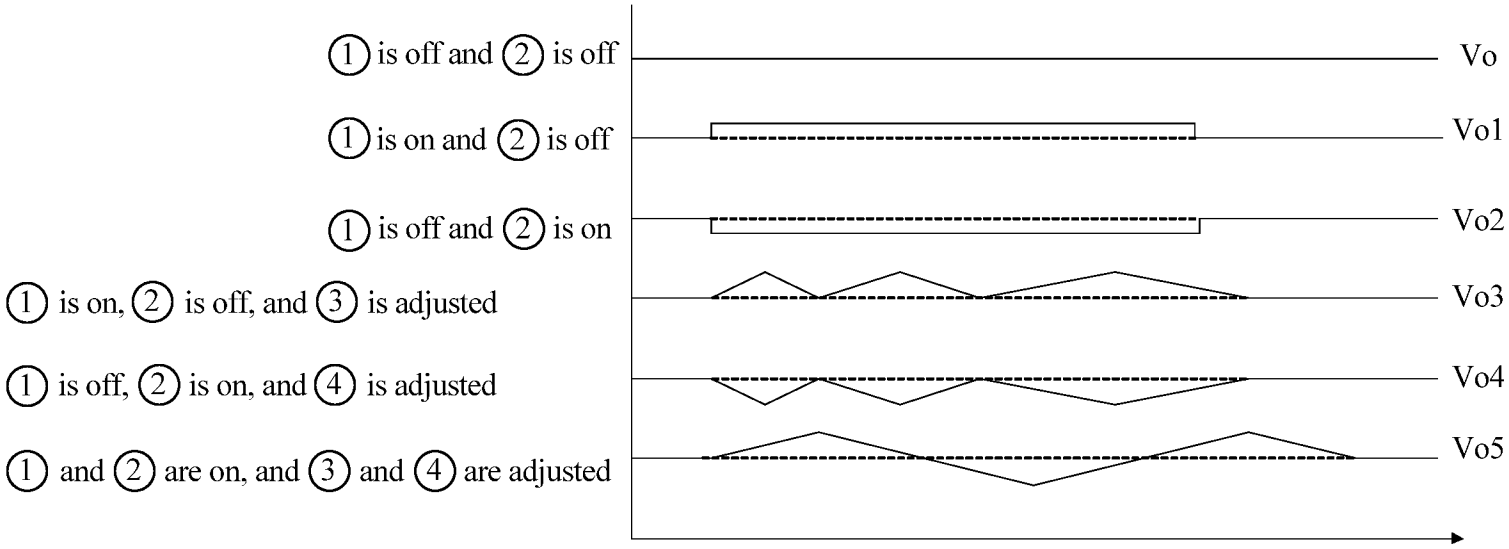
FIG. 4B is a waveform graph of an output voltage in FIG. 4A.

Referring to FIG. 4A, a first bias resistor 7 is R1, a second bias resistor 8 is R2, a first digital potentiometer is Rp1, and a second digital potentiometer is Rp2. In an online voltage adjustment process for the board power supply, a detection chip 1 samples an output voltage of an output pin, to obtain an initial output voltage, and sends the initial output voltage to a control chip 2. The control chip 2 controls Rp1 and Rp2 based on a preset voltage and the initial output voltage to change an FB value, and adjust the initial output voltage to a target voltage, thereby implementing online voltage adjustment of a dynamic bias of the output voltage. The adjustment and change are shown in Table 2

TABLE 2

| Sequence number | Control sequence | Change of an FB value | Change of an output voltage Vo | Symbol Vo |
|---|---|---|---|---|
| 0 | ① is off and ② is off | — | — | Vo |
| 1 | ① is on and ② is off | ↑ | ↑ | Vo1 |
| 2 | ① is off and ② is on | ↓ | ↓ | Vo2 |
| 3 | ① is on, ② is off, and ③ is adjusted | Dynamically ↑ | Dynamically ↑ | Vo3 |
| 4 | ① is off, ② is on, and ④ is adjusted | Dynamically ↓ | Dynamically ↓ | Vo4 |
| 5 | ① and ② are on, and ③ and ④ are adjusted | Dynamically ↑ or ↓ | Dynamically ↑ or ↓ | Vo5 |

Referring to Table 2, a first switch 5 is denoted as ①, a second switch 6 is denoted as ②, Rp1 is denoted as ③, Rp2 is denoted as ④, an input value of an FB pin is denoted as an FB value, and the initial output voltage is denoted as Vo. In this case, when the control chip 2 controls the first switch 5 to be off and the second switch 6 to be off, the output voltage of the board power supply remains unchanged, to be specific, the initial voltage is used as the target voltage. When the control chip 2 controls the first switch 5 to be on and the second switch 6 to be off, the FB value of the board power supply increases, and the output voltage also increases. For example, the initial output voltage increases to a first voltage Vo1, and Vo1 is used as the target voltage, and a value of Vo1 is related to resistance values of Rp1. When the control chip 2 controls the first switch 5 to be off and the second switch 6 to be on, the FB value of the board power supply decreases, and the output voltage also decreases. For example, the initial output voltage decreases to a second voltage Vo2, Vo2 is used as the target voltage, and a value of Vo2 is related to resistance values of Rp2. When the control chip 2 controls the first switch 5 to be on and the second switch 6 to be off, and adjusts Rp1, the FB value of the board power supply dynamically changes, and the output voltage also dynamically changes. For example, the output voltage gradually increases from the initial output voltage to a first voltage Vo1, or gradually decreases from Vo1 to the initial output voltage to obtain a target voltage that is represented as Vo3. Vo3 is between the initial voltage and Vo1, and a value of Vo1 is related to resistance values of Rp1. When the control chip 2 controls the first switch 5 to be off and the second switch 6 to be on, and adjusts Rp2, the FB value of the board power supply dynamically changes, and the output voltage also dynamically changes. For example, the output voltage gradually decreases from the initial output voltage to a second voltage Vo2, or gradually increases from Vo2 to the initial output voltage to obtain a target voltage that is represented as Vo4. Vo4 is between the initial voltage and Vo2, and a value of Vo2 is related to resistance values of Rp2. When the control chip 2 controls the first switch 5 to be on and the second switch 6 to be on, and adjusts Rp1 and Rp2, the FB value of the board power supply dynamically changes, and the output voltage also dynamically changes. For example, the output voltage gradually increases from the initial output voltage to a first voltage Vo1, and gradually decreases from Vo1 to Vo2, and then gradually increases from Vo2 to Vo1 to obtain a target voltage that is represented as Vo5. Vo5 is between Vo2 and Vo1, and values of Vo2 and Vo1 are related to resistance values of Rp1 and Rp2.

Referring to FIG. 4B, when the control chip 2 controls states of the first switch, the second switch, and Rp1 or Rp2 to change, the output voltage of the board power supply, namely, a waveform of the target voltage, also changes. In addition, a bias amplitude of the voltage output is related to the resistance value of the first voltage division circuit and the resistance value of the second voltage division circuit. The resistance value of Rp1 or the resistance value of Rp2 is adjusted, to implement an output voltage bias ranging from ±0.5% to ±10%.

It should be noted that the circuit in FIG. 4A shows only partial components, and the circuit provided in this embodiment of this application further includes another element, such as an inductor L.

In the foregoing embodiments, the first switch is a switching transistor or a metal-oxide semiconductor field-effect transistor (MOSFET), and the second switch is a switching transistor or a MOSFET.

Persons of ordinary skill in the art may understand that all or some of the steps of the method embodiments may be implemented by a program instructing related hardware. The program may be stored in a computer-readable storage medium. When the program runs, the steps of the method embodiments are performed. The storage medium includes any medium that can store program code, such as a read-only memory (ROM), an electrically erasable programmable ROM (EEPROM), or a flash memory.

Finally, it should be noted that the foregoing embodiments are merely intended for describing the technical solutions of this application, not limiting this application. Although this application is described in detail with reference to the foregoing embodiments, persons of ordinary skill in the art should understand that they may still make modifications to the technical solutions described in the foregoing embodiments or make equivalent replacements to some or all technical features thereof, without departing from the scope of the technical solutions of the embodiments of this application.

What is claimed is:

1. An online voltage adjustment circuit for a board power supply, comprising:
- a first switch;
- a first bias resistor, wherein a first end of the first bias resistor is configured to couple to an output pin of the board power supply;
- a first voltage division element comprising a first voltage division resistor and coupled in series to the first switch to form a first voltage division circuit, wherein the first voltage division circuit is coupled in parallel to the first bias resistor;
- a second switch;
- a second bias resistor, wherein a first end of the second bias resistor is configured to couple to a ground pin of the board power supply, wherein the first bias resistor is further configured to couple in series to the second bias resistor;
- a second voltage division element comprising a second voltage division resistor and coupled in series to the second switch to form a second voltage division circuit, wherein the second voltage division circuit is coupled in parallel to the second bias resistor, wherein the first voltage division circuit is further configured to couple in series to the second voltage division circuit; wherein a first coupling point couples the first voltage division circuit to the second voltage division circuit, wherein a second coupling point couples the first bias resistor;
- a control chip coupled to the first switch and the second switch; and
- a detection chip, wherein a first end of the detection chip is coupled to the output pin, wherein a second end of the detection chip is coupled to the control chip, and wherein the detection chip is configured to obtain an initial output voltage of the output pin, and
- wherein the control chip is configured to:
  - control, based on the initial output voltage and a preset voltage, the first switch and the second switch;
  - control the first switch to be off and the second switch to be off;
  - set the initial output voltage as a target voltage; and
  - adjust the initial output voltage to the target voltage.

2. The online voltage adjustment circuit of claim 1, wherein the control chip is further configured to obtain the preset voltage.

3. The online voltage adjustment circuit of claim 1, wherein the first switch is a metal-oxide semiconductor field-effect transistor (MOSFET), and wherein the second switch is a switching transistor.

4. The online voltage adjustment circuit of claim 1, wherein the first switch is a switching transistor, and wherein the second switch is a metal-oxide semiconductor field-effect transistor (MOSFET).

5. The online voltage adjustment circuit of claim 1, wherein the first switch is a first metal-oxide semiconductor field-effect transistor (MOSFET), and wherein the second switch is a second MOSFET.

6. The online voltage adjustment circuit of claim 1, wherein the control chip is an advanced reduced instruction set computing (RISC) machines (ARM), a micro control unit (MCU), or a complex programmable logical device (CPLD).

7. The online voltage adjustment circuit of claim 1, wherein the detection chip is coupled to the control chip by an inter-integrated circuit (I2C) or a low pin count (LPC) interface.

8. The online voltage adjustment circuit of claim 1, wherein a fixed bias ratio is determined based on resistance values of the first voltage division circuit and the second voltage division circuit.

9. An online voltage adjustment circuit for a board power supply, comprising:
- a first switch;
- a first bias resistor, wherein a first end of the first bias resistor is configured to couple to an output pin of the board power supply;
- a first voltage division element comprising a first voltage division resistor and coupled in series to the first switch to form a first voltage division circuit, wherein the first voltage division circuit is coupled in parallel to the first bias resistor;
- a second switch;
- a second bias resistor, wherein a first end of the second bias resistor is configured to couple to a ground pin of the board power supply, wherein the first bias resistor is further configured to couple in series to the second bias resistor;
- a second voltage division element comprising a second voltage division resistor and coupled in series to the second switch to form a second voltage division circuit, wherein the second voltage division circuit is coupled in parallel to the second bias resistor, wherein the first voltage division circuit is further configured to couple in series to the second voltage division circuit, wherein a first coupling point couples the first voltage division circuit to the second voltage division circuit, wherein a second coupling point couples the first bias resistor to the second bias resistor, and wherein the second coupling point is configured to couple the first coupling point to a feedback pin of the board power supply;

a control chip coupled to the first switch and the second switch; and a detection chip, wherein a first end of the detection chip is coupled to the output pin, wherein a second end of the detection chip is coupled to the control chip, and wherein the detection chip is configured to obtain an initial output voltage of the output pin, and wherein the control chip is configured to:

control, based on the initial output voltage and a preset voltage, the first switch and the second switch;

control the first switch to be on and the second switch to be off;

increase the initial output voltage to a first voltage; and set the first voltage as a target voltage.

10. An online voltage adjustment circuit for a board power supply, comprising:

a first switch;

a first bias resistor, wherein a first end of the first bias resistor is configured to couple to an output pin of the board power supply;

a first voltage division element comprising a first voltage division resistor coupled in series to the first switch to form a first voltage division circuit, wherein the first voltage division circuit is coupled in parallel to the first bias resistor;

a second switch;

a second bias resistor, wherein a first end of the second bias resistor is configured to couple to a ground pin of the board power supply;

a second voltage division element comprising a second voltage division resistor coupled in series to the second switch to form a second voltage division circuit, wherein the second voltage division circuit is coupled in parallel to the second bias resistor, wherein the first bias resistor is further configured to couple in series to the second bias resistor, wherein the first voltage division circuit is further configured to couple in series to the second voltage division circuit, wherein a first coupling point couples the first voltage division circuit and the second voltage division circuit, wherein a second coupling point couples the first bias resistor and the second bias resistor, and wherein the second coupling point is configured to couple the first coupling point to a feedback pin of the board power supply;

a control chip coupled to the first switch and the second switch; and a detection chip, wherein a first end of the detection chip is coupled to the output pin, wherein a second end of the detection chip is coupled to the control chip, and wherein the detection chip is configured to obtain an initial output voltage of the output pin, and wherein the control chip is configured to:

control, based on the initial output voltage and a preset voltage, the first switch and the second switch;

control the first switch to be off and the second switch to be on;

reduce the initial output voltage to a second voltage; and set the second voltage as a target voltage.

11. An online voltage adjustment circuit for a board power supply, comprising:

a first switch;

a first bias resistor, wherein a first end of the first bias resistor is configured to couple to an output pin of the board power supply;

a first voltage division element comprising a first digital potentiometer and is coupled in series to the first switch to form a first voltage division circuit, wherein the first voltage division circuit is coupled in parallel to the first bias resistor;

a second switch;

a second bias resistor, wherein a first end of the second bias resistor is configured to couple to a ground pin of the board power supply wherein the first bias resistor is further configured to couple in series to the second bias resistor;

a second voltage division element comprising a first digital potentiometer and is coupled in series to the second switch to form a second voltage division circuit, wherein the second voltage division circuit is coupled in parallel to the second bias resistor, wherein the first voltage division circuit is further configured to couple in series to the second voltage division circuit, wherein a first coupling point couples the first voltage division circuit and the second voltage division circuit, wherein a second coupling point couples the first bias resistor and the second bias resistor, and wherein the second coupling point is configured to couple the first coupling point to a feedback pin of the board power supply;

a detection chip, wherein a first end of the detection chip is coupled to the output pin, wherein the detection chip is configured to obtain an initial output voltage of the output pin, and a control chip coupled to the first switch and the second switch, wherein a second end of the detection chip is coupled to the control chip, and wherein the control chip is configured to:

control, based on the initial output voltage and a preset voltage, the first switch and the second switch;

couple to the first digital potentiometer and the second digital potentiometer; and adjust the initial output voltage to a target voltage.

12. The online voltage adjustment circuit of claim 11, wherein the control chip is further configured to:

control the first switch to be off and the second switch to be off; and set the initial output voltage as the target voltage.

13. The online voltage adjustment circuit of claim 11, wherein the control chip is further configured to:

control the first switch to be on and the second switch to be off;

increase the initial output voltage to a first voltage; and set the first voltage as the target voltage.

14. The online voltage adjustment circuit of claim 13, wherein the control chip is further configured to adjust the first digital potentiometer, and wherein the target voltage is between the initial output voltage and the first voltage.

15. The online voltage adjustment circuit of claim 11, wherein the control chip is further configured to:

control the first switch to be off and the second switch to be on;

reduce the initial output voltage to a second voltage; and set the second voltage as the target voltage.

16. The online voltage adjustment circuit of claim 15, wherein the control chip is further configured to adjust the second digital potentiometer, and wherein the target voltage is between the second voltage and the initial output voltage.

17. The online voltage adjustment circuit of claim 11, wherein the control chip is further configured to:

control the first switch to be on and the second switch to be on; and adjust the first digital potentiometer and the second digital potentiometer, wherein the target voltage is between a first voltage and a second voltage.

18. An online voltage adjustment circuit for a board power supply, comprising:

a first switch comprising a first switching transistor;

a first bias resistor, wherein a first end of the first bias resistor is configured to couple to an output pin of the board power supply;

a first voltage division element coupled in series to the first switch to form a first voltage division circuit, wherein the first voltage division circuit is coupled in parallel to the first bias resistor;

a second switch comprising a second switching transistor;

a second bias resistor, wherein a first end of the second bias resistor is configured to couple to a ground pin of the board power supply;

a second voltage division element coupled in series to the second switch to form a second voltage division circuit, wherein the second voltage division circuit is coupled in parallel to the second bias resistor, wherein the first bias resistor is further configured to couple in series to the second bias resistor, wherein the first voltage division circuit is further configured to couple in series to the second voltage division circuit, wherein a first coupling point couples the first voltage division circuit and the second voltage division circuit, wherein a second coupling point couples the first bias resistor and the second bias resistor, and wherein the second coupling point is configured to couple the first coupling point to a feedback pin of the board power supply;

a control chip coupled to the first switch and the second switch; and a detection chip, wherein a first end of the detection chip is coupled to the output pin, wherein a second end of the detection chip is coupled to the control chip, and wherein the detection chip is configured to obtain an initial output voltage of the output pin, and wherein the control chip is configured to:

control, based on the initial output voltage and a preset voltage, the first switch and the second switch; and adjust the initial output voltage to a target voltage.

19. The online voltage adjustment circuit of claim 18, wherein the control chip is further configured to:

control the first switch to be on and the second switch to be on; and adjust a first digital potentiometer and a second digital potentiometer, wherein the target voltage is between a first voltage and a second voltage.

20. The online voltage adjustment circuit of claim 10, wherein the control chip is further configured to:

control the first switch to be on and the second switch to be on; and adjust a first digital potentiometer and a second digital potentiometer, wherein the target voltage is between a first voltage and the second voltage.

* * * * *